US011369548B2

(12) United States Patent
Tesini et al.

(10) Patent No.: US 11,369,548 B2
(45) Date of Patent: Jun. 28, 2022

(54) VARIED RESPONSE TEETHER

(71) Applicants: David A. Tesini, Hopkinton, MA (US); Joshua Wiesman, Weston, MA (US)

(72) Inventors: David A. Tesini, Hopkinton, MA (US); Joshua Wiesman, Weston, MA (US)

(73) Assignee: TW Innovations, LLC, Hopkinton, MA (US)

( * ) Notice: Subject to any disclaimer, the term of this patent is extended or adjusted under 35 U.S.C. 154(b) by 832 days.

(21) Appl. No.: 15/849,117

(22) Filed: Dec. 20, 2017

(65) Prior Publication Data

US 2018/0177685 A1 Jun. 28, 2018

Related U.S. Application Data

(60) Division of application No. 13/018,663, filed on Feb. 1, 2011, now abandoned, which is a continuation of application No. PCT/US2009/054125, filed on Aug. 18, 2009.

(60) Provisional application No. 61/300,079, filed on Feb. 1, 2010.

(51) Int. Cl.
*A61J 17/02* (2006.01)

(52) U.S. Cl.
CPC ..... *A61J 17/02* (2013.01)

(58) Field of Classification Search
CPC ..... A61J 17/00; A61J 17/02; A61J 2017/001; A61J 2017/006; A61J 11/00; A61J 11/0035; A61J 11/0055; A61J 11/0065; A61H 13/00
See application file for complete search history.

(56) References Cited

U.S. PATENT DOCUMENTS 2,826,201 A * 3/1958 Yoder ..... A61J 17/02 606/235
3,267,937 A * 8/1966 Verschoor ..... A61J 17/001 606/236
5,048,143 A * 9/1991 Carroll ..... A46B 5/02 15/105
D335,060 S * 4/1993 Dial ..... D6/604
D368,991 S * 4/1996 O'Rourke ..... D30/160
5,649,964 A * 7/1997 Berman ..... A61J 17/02 601/139
5,766,223 A * 6/1998 Johnson ..... A61J 17/02 606/235
D420,447 S * 2/2000 Rohrig ..... D24/193
6,056,774 A * 5/2000 Johansen ..... A61J 17/02 606/234
D453,401 S * 2/2002 Kaplan ..... D21/406
6,447,536 B1 * 9/2002 Hinshaw ..... A61J 17/02 606/235
D480,147 S * 9/2003 Sanbrook ..... D24/193
6,863,681 B2 * 3/2005 Dickerson ..... A61J 7/0053 606/235
6,905,507 B2 * 6/2005 Hinshaw ..... A61J 17/02 606/235
8,910,809 B2 * 12/2014 Fischer ..... B29C 45/14336 215/11.1

(Continued)

*Primary Examiner* — Tuan V Nguyen
(74) *Attorney, Agent, or Firm* — Brian M. Dingman; Dingman IP Law, PC

(57) ABSTRACT

A varied response teether with an outer surface created at least in part by a first elastomeric material and an inner portion including an elastomeric material that has at least one different property than the first elastomeric material.

12 Claims, 10 Drawing Sheets

(56) References Cited

U.S. PATENT DOCUMENTS

| | | | | |
|---|---|---|---|---|
| 2002/0077663 | A1* | 6/2002 | Hinshaw | A61J 17/02<br>606/235 |
| 2004/0210252 | A1* | 10/2004 | Minoguchi | A61J 17/1011<br>606/234 |
| 2005/0080456 | A1* | 4/2005 | Sanbrook | A61J 17/02<br>606/235 |
| 2005/0123882 | A1* | 6/2005 | Tesini | A61C 9/00<br>433/229 |

* cited by examiner

VARIED RESPONSE TEETHER

CROSS-REFERENCE TO RELATED APPLICATIONS

This application is a Divisional of and claims priority of application Ser. No. 13/018,663, filed on Feb. 1, 2011, which itself claimed priority of PCT/US2009/054125 filed on Aug. 18, 2009, and also claimed priority of Provisional application Ser. No. 61/300,079 filed on Feb. 1, 2010.

FIELD

This disclosure relates to a teether.

BACKGROUND

Infants have been observed for centuries biting on all types of objects during the period known as "teething". This has been interpreted as a way of "relieving" the pain presumed associated with the process. As teething typically occurs during infant ages 5 months to 24 months, the pressure areas may be the gum pads (alveolar ridges), the erupting or newly erupted teeth, or a combination of both teeth and gums. A "teether" is a device that is designed to be chewed on by an infant to address teething-related issues.

Human feeding is dependent on an integrated sequence of events requiring the coordination of over 20 muscles to move food and saliva in the mouth, from the first chew to the swallow. Children's oral motor development begins with the mouth working as a total unit, but as the child matures, the movement of jaws, the tongue and lips function as separate, but coordinated entities. There is a progression over time with corresponding development of the jaw joint (TMJ) which adds jaw stability needed to chew foods varying in firmness, size and texture. More recent research (Lundy et al. 1998) added to the understanding that early perceptual and discriminatory abilities also develop between infancy and early toddlerhood.

It has been demonstrated that the oro-motor developmental stages of the child (jaw movement, masticatory muscle functions, i.e., feeding functions, tongue functions and eruption of the teeth) has an influence on what textures are accepted or rejected (Szczesniak, 1972). Simply put, the child knows what types of food she can eat and what types she cannot. Infants start out with only liquids and at 4-6 months the diet is complemented with the first solid foods, which are semi-liquid (e.g., pureed fruits or vegetables). At around six months teeth will develop and the lateral/more advanced movement of chewing begins. By this stage infants have experienced different textures and learn to like textures that can be easily manipulated by their tongue, lips and gums. These preferences are determined by their prior experience with texture variations.

In fact, over the first two-years of a child's life, the most marked period of increasing oral skill occurs between the age of six and ten months for the more solid textures. Further increases in chewing efficiency continue up to 24-36 months (Gisel, E. G., 1991). This corresponds directly with the "teething stage" (the eruption of teeth and the downward and forward movement of the mandible). The chronological link between chewing and teething thereby has been established. What the Science Teaches:

1. As the child matures, the movement of jaws, the tongue and lips function as separate, but coordinated entities.
2. Jaw movement, masticatory muscle functions, i.e., feeding functions, tongue functions and eruption of the teeth have an influence on what textures are accepted or rejected. Simply put, the child knows what types of food she can eat and what types she cannot.
3. The child must strengthen their muscles and coordination skills in order to progress along the feeding and speech path.
4. During the most critical time of oral development (age 6-24 months) the child's muscles/joints/tongue learn to handle and coordinate the eating of complex solids. This corresponds directly with the eruption of teeth.

SUMMARY

This disclosure features a teether (or series of teethers) with a varied response to biting. The teether can replicate and coordinate this natural progression. The teether can achieve the various textures, firmness and compressibility of different foodstuffs. Through textures, design features and teether response the teether can replicate and coordinate the child's natural feeding and speech progression. Training the child with the teether can accelerate transitions between feeding stages and help develop control required for speech.

The teether can be embodied in various designs that capture aspects of design that are most appropriate for the age or stage of development of the child, typically one that mimics feeding progression. Such development stages may include the following groups: Stage one—liquids (mostly sucking and oral positioning development). Stage two—soft solids (special relations and starting development of the grinding of food and swallow, early speech development). Stage three—solids (chew and focus on temporomandibular joint (TMJ) development and speech development).

For example, the various embodiments of the teether can include traditional teether shapes, or unique or non-traditional shapes. The width and thickness of biting surfaces can be varied according to tolerance at each developmental stage. The thickness of the portions of the teether that are designed to be bitten can change by the appropriate amount according to the age/stage of development of the child. Generally this incremental change in thickness is a 1-3 mm increase per stage, e.g., stage one may be 6-8 mm thick, stage two 8-11 mm thick, and stage three 11-13 mm thick.

The generalization of Hooke's law is often used when studying stress, strain, and recovery as related to material science of polymers. This generalization takes into account several idealistic assumptions disregarding true material science on a micro scale. Using a linear relationship between stress and strain assumes that each of the six independent components of stress is linearly related to each of the six independent components of strain. For simplicity we also generally show a schematic of a deforming cube to consider change in a unit dimension, i.e., a cube has dimensions x, y, and z and upon deformation the cube deforms to a parallel with deformation ratios $\lambda_1$, $\lambda_2$, and $\lambda_3$. When looking at an object that is more "real world" like a strawberry, it is often useful to discount the micro system and focus purely on the macro simplified system. This is done because the micro behavior is not always relevant for simple studies of bite force.

In showing the displacement vs. force diagram, which can correlate to a stress strain curve for ideal cases like the simplified cube above, the micro behavior (initial behavior when the teeth contact and start to apply a force) is ignored and the macro behavior is observed. That is to say, the berry technically behaves elastically from the time when the teeth contact the surface until the teeth break the surface tension of the skin creating an immediate plastic (non recoverable)

deformation. Instead of looking at this deformation on a micro scale, it was elected to look at it in a more macro picture.

Now, objects like a banana, a strawberry and a small block of cheese can be used to correlate teething to teethers as these are the foods that generally follow soft purees in food progression. It would be foolish to feed a child liquid and then hand the child a piece of steak (or another elastically tough food).

FIG. 10 is a Textured Profile Analysis (TPA) of a strawberry. The analysis is run using an Instron testing device and a specific force/displacement program to represent a bite. The problem is that instead of a mouth and tooth interface the test is run using two flat plates. The 1 and 2 displayed on the graph could correlate to bite one and bite two or could correlate to the moments at which the berry transfers from elastic to plastic and then pulp. If one looks at the graph one would see that the elastic stage of the strawberry lasts for approximately 2-3 mm of displacement by the flat plate. After 2-3 mm displacement and the increase in force the plastic stage takes place—the majority of the curve. What the testing and graph neglects to show, due to logistical limitations, is the following bites and resulting puree that exists prior to swallow.

Contributing Assumptions when Examining a Child's Bite

While the magnitude of a bite is important, the angles of loading may actually be more important. Consider a system with three primary angles of loading. The "C" loading angle is defined as the direction of condylar loading which occurs when the mandible is in retruded, or molar biting position. The protruded loading angle, "P", is defined as the direction of condylar loading which occurs when the mandible is translated forward to a position of incisal biting or suckling. The mean condylar loading angle "M" is defined as a time-dependent mix of retruded loading angle and the protruded loading angle. From the following equation we are able to study the condylar loading angle and the eminence development angle as a function of age and development.

$$M=Kp(P)+Kr(C)$$

Where the K ratios define a constant that equals the proportion of time the condyle was assumed to be loaded in either protruded or retruded position (constant K is documented in Nickel et al, J Dent Res, June 1988).

The combination of understanding angle of bite and load of bite (that will be discussed in the next section) together with material science allows the development of a teether that better correlates to a child's development.

Strength of a Child's Bite and Teethers

A well documented and referenced paper in the Journal of Dental Research titled *A Theoretical Model of Loading and Eminence Development of the Postnatal Human Temporomandibular Joint*, Nickel, J C, et al 1988, addresses the bite force as it correlates to development of the oral-facial anatomy. From this paper we use the following as reference data: Age 0-5 months bite force is 1.76 lbs or 800 grams (Ardran, et al 1958). The linear relationship between growth and bite force for early development allows us to assume age 6-12 months bite force is 3.52 lbs. and age 12-18 months bite force is 7.04 lbs.

Using this data and applying it with knowledge of feeding development, speech development, physiological development and material science we developed the teether. We tested the feedback response (correlation between applied force and resulting deformation) of these teethers vs. competitors. One of the resulting graphs is shown in FIG. 11.

Breaking down the FIG. 11 graph into simple statements the following observations can be made:

Prior art teether "Comp A" was selected because it seemed to include features and use construction that is representative to the majority of the currently marketed teether products. The polypropylene section was tested for the following reasons: 1) We believed this was the intended bite surface based on design, 2) The teether was made and marketed by one of the largest baby product companies 3) It was stated to be designed for ages 6+mos which is generally considered stage 3 (most similar to a strawberry on the feeding scale). The teether appeared to be constructed by combining injection molded parts by process of ultrasonic weld.

If further tested, the material in "Comp A" (an existing teether made of a combination of polypropylene and polycarbonate parts) would reach ultimate strength and catastrophically fail much faster than materials shown in the other three lines that show the same testing of three versions of the teether herein. The graph shows how fatigue and crack growth will developed as a function of increased stress. At equal forces the material combinations in the inventive teethers will result in greater response and better durability.

As force increases the response continues in the inventive teethers, but is different per each design due to the combinations (material selection, thicknesses and combinations) selected. The cross sectional design or breakdown of teethers herein were simplified models as follows:

a. Stage 1: 1.5 mm 50A Silicone, 3 mm 25A Silicone, 1.5 mm 50A Silicone.
b. Stage 2: 1.5 mm 50A Silicone, 3 mm 50A Silicone, 1.5 mm 50A Silicone.
c. Stage 3: 1.5 mm 50A Silicone, 3 mm 90A Silicone, 1.5 mm 50A Silicone.

The testing described above was done using samples that were constructed from sheet stock material with 1.5 mm thickness and durometers as specified. From the sheet stock 3" round discs were cut-out to use for compression testing. For example, the Stage 1 test teether was constructed by placing 4 of the cut-out discs of stock material together one on top of another, i.e., 1 piece of 50A silicone, 2 pieces of 25A silicone and another piece of 50A silicone.

Materials Application & Viscoelastic Superposition Principles

Boltzmann proposes the following items:

1) Creep is a function of the entire past loading history of the specimen.
2) Each loading step makes an independent contribution to the final deformation, so that the total deformation can be obtained by the addition of all the contributions.

By knowing average bite force and average bite angle and applying an understanding of the physiological needs of a developing oral environment we are able to create a "smart teether." We combine the principles of food texture analysis and linear viscoelasticity of materials to mimic and/or create a training tool that has the ability to store all external forces and energy during deformation and harness that same energy to restore the original shape of the object when the external force is removed. The harnessing of external forces can be adjusted by adjusting material properties to effectively create a restorative force response that is either equal, or lesser than applied force, i.e., the material may snap back quickly or may more slowly creep back to original shape. This dramatic form of response, which combines both liquid-like and solid-like features is what makes a viscoelastic material commercially and medically appealing for use in teether development.

Because a bite can be considered a two-step loading cycle (primary bite followed by smaller secondary bite as illustrated in FIG. 10) using the Boltzmann principles on projected stresses and viscoelastic response (figure below) combined with stress relaxation modulus theory (the material relationship to stress relaxation behavior as a function of time) will assure the teethers respond as intended.

FIGS. 12A and 12B are a schematic model of a viscoelastic material and corresponding creep recovery curve, respectively. The viscoelastic material has the ability to operate as a controllable spring with a separately controlled dashpot.

The TPA Food Texture Analysis can be used to test the foods that a developing (growing) child would eat, and a teether can be designed that matches the behavior of those respective foods. Simply put, taking the force vs. displacement graphs and knowing the timescale of the test we are able to create a schematic model (as depicted above) that will closely match the results. We can use viscoelastic theory to simulate a food using polymers.

Feedback Response and Correlations Between Physical Measures and Sensory Response.

Sensory intensity scales and physical measurements can objectively follow defined models of psychophysical relationships. For example the power model of sensory response (R) can be described by the equation:

$$R=CS^n$$

Where R=Sensory Response,

S=stimulus (bite for example)

C and n are constants related to food/materials properties.

Firmness can be studied in squeeze tests quantifying mechanical resistance by the following formula:

$$M_c=M_tM_x/(M_t+M_x)$$

$M_c$=combined mechanical resistance $M_t$=the resistance of the teeth $M_x$=the resistance to deformation of the specimen So, when a soft material (test specimen or food) is deformed between the teeth, $M_c=M_x$; the sensory response is primarily determined by the properties of the test specimen (or food).

Case Study Design

Knowing the input forces, angles, relative time frames and environmental conditions for our "problem statement," we are able to design studies that will produce both theoretical and empirical results. In designing a stage-specific teether, for the sake of example let us select stage 3 (6+ months of age, where Stage 1=3+ months, Stage 2=4+ months, Stage 3=6+ months and Stage 4=9+ months), we are able to model the system using a visual energy balance, as shown in FIGS. 12A and 12B. What this does is allow us to produce a teether, on a case by case linear system, that functions as we intend. In simple theory this means that the necessary spring constant and the necessary damping constant dictate the output response of the teether that is needed to mimic the response of the food.

Taking this theory and applying it to a teether design, what needs to occur to design the teether based on energy/material theory, is to build a prototype or equivalent test sample, build a custom TPA food analysis test station or use a TPA food analysis testing service to test and record data for teether response, review and statistically analyze the test results, and iterate the design as needed to achieve the desired result.

Featured herein is a varied response teether, comprising an outer surface created at least in part by a first elastomeric material and an inner portion comprising an elastomeric material that has at least one different property than the first elastomeric material. The inner portion may further comprise one or more voids. The restorative response of the teether may be delayed compared to the rate of the applied force. The restorative response of the teether may be approximately equal to that of the rate of the applied force. The teether materials and construction may be selected based at least in part on a viscoelastic model with a spring and damping response to applied external forces. The viscoelastic response may be designed to respond or react to a two stage loading of external forces, similar to a bite pattern.

At least the outer portion of the teether may be able to rotate on an axle. The teether may further comprise a main body, and a ring that can rotate around the main body of the teether. The teether may define angled surfaces. The angled surfaces may be created by at least one peak and at least one valley. The inner portion may be softer than the outer portion. The inner portion may have a hardness of about 25A and the outer portion may have a hardness of about 50A. The inner portion may be harder than the outer portion. The inner portion may have a hardness of about 90A and the outer portion may have a hardness of about 50A.

Also featured is a method of designing a teether, comprising testing certain foodstuffs to determine their response to compressive force and using the test results to determine a force-responsive quality of a teether. Further featured is a teether designed by this methodology.

BRIEF DESCRIPTION OF THE DRAWINGS

Other aspects will occur to those skilled in the art from the following description of preferred embodiments and the accompanying drawings, in which.

DESCRIPTION OF PREFERRED EMBODIMENTS

FIGS. 1 through 4 are schematic cross-sectional representations of four different embodiments of the teether.

Figure 1:
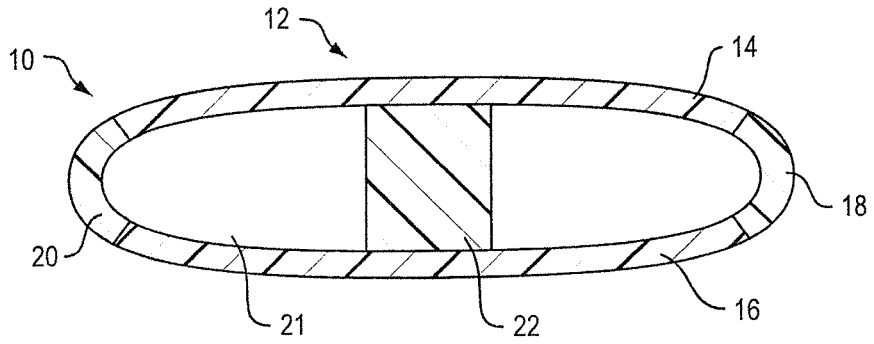
FIG. 1 is a simplified side cross-sectional view of a first embodiment of the teether.

Teether 10, FIG. 1, includes outer shell 12 that comprises upper and lower sections 14 and 16 respectively that are made of the same durometer material, and end sections 18 and 20 that may be of a different material. For example, the upper and lower sections 14 and 16 may be comprised of a 50-90A elastomeric material, while the two end sections 18 and 20 may be a 50-60A material. The softer durometer end sections are preferred so that flexing and compression does not lead to premature fatigue of the joint or living hinge that is effectively created. Because the bulk of the exterior flexing will take place at these end sections the material must be able to withstand creep deformation and repeated stress and strain cycles without failure. The upper and lower portions serve as interface or bite surfaces for the child. The purpose of these is to receive the external force applied by the gum pads or teeth and distribute that force in such a way that the internal damping/spring mechanism (a different viscoelastic material), and the end pieces are able to function as a shock absorber-like system. When external force is applied the response is controlled by the material Shore hardness and the viscoelastic responsiveness of the materials selected for the internal and end members. The interior 21 includes a portion of material 22 located between top and bottom 14 and 16. The rest of the interior may be of a different material or it may be empty. Material 22 is preferably elastomeric or elastomer-like. This construction creates a teether that is compressible and requires greater force as the compression proceeds. The device returns to its original position when the bite force is released. This return to position may be equal or slower than the rate of the applied force as this would correlate to food response during chewing. Portion 22 could alternatively be accomplished with a gel such as a hydro gel or a granular material such as sand.

Figure 2:
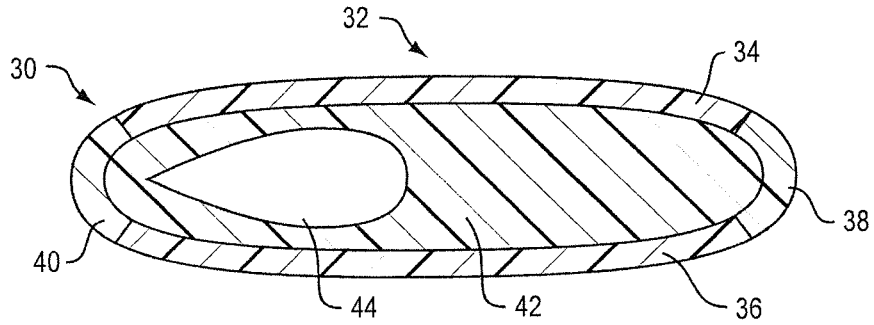
FIG. 2 is a simplified side cross-sectional view of a second embodiment of the teether.

Embodiment 30, FIG. 2 also includes a shell 32 with upper and lower portions 34 and 36 made of one material and end portions 38 and 40 that can be made of a different material to provide a desired response when a bite force is applied. In this case, interior 42 is filled with a material with the exception of one or more voids 44. Material 42 is preferably a different elastomer. Void 44 helps to accomplish a squishy feeling, but since the void is not evenly distributed across the teether, the force required to compress the teether varies in different locations on the teether. This thus accomplishes a variable bite force at different locations on the teether.

Figure 3:
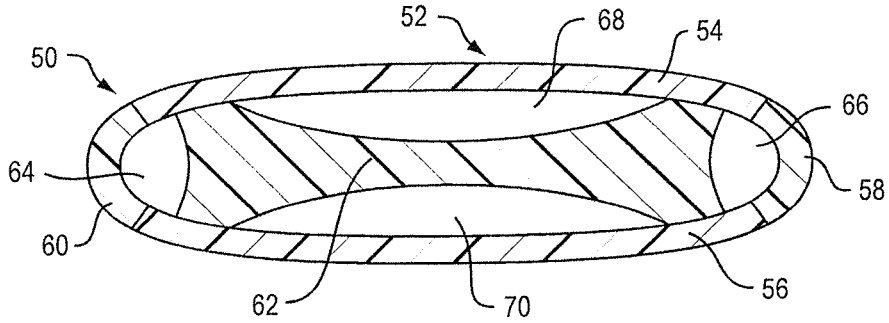
FIG. 3 is a simplified side cross-sectional view of a third embodiment of the teether.

In another similar embodiment 50, FIG. 3, shell 52 comprises upper and lower layers 54 and 56 and end portions 58 and 60, each of which as in the other embodiments is preferably an elastomer such as silicone. The elastomeric interior bridging portion 62 is connected between surfaces 54 and 56, but accomplishes variable void areas 64, 66, 68 and 70 that tailor the bite force/compressibility response of the teether at different locations and dependent on the degree of compression.

Figure 4:
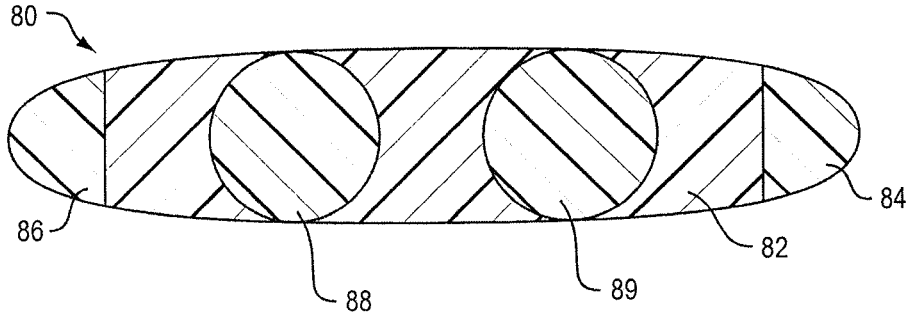
FIG. 4 is a simplified side cross-sectional view of a fourth embodiment of the teether.
Figure 5A:
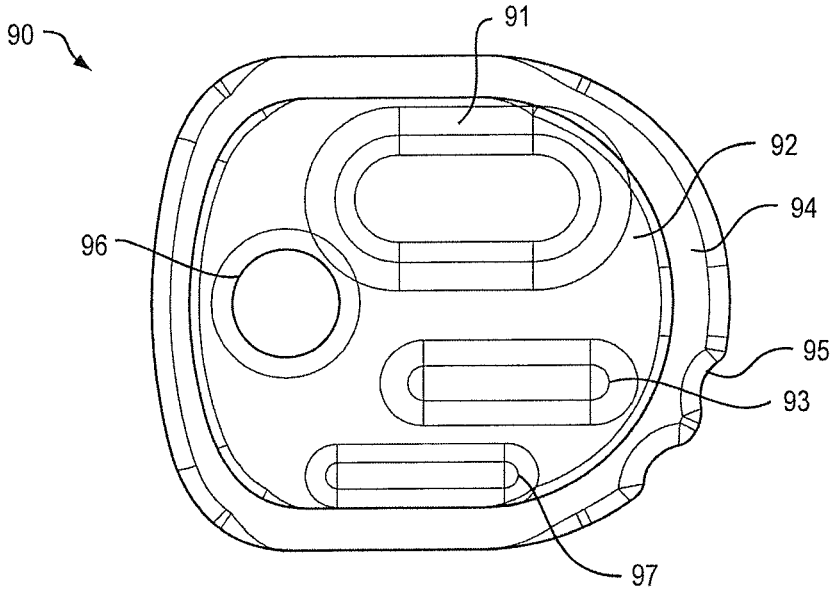
FIGS. 5A-5D are views of one embodiment of the teether.
Figure 5B:
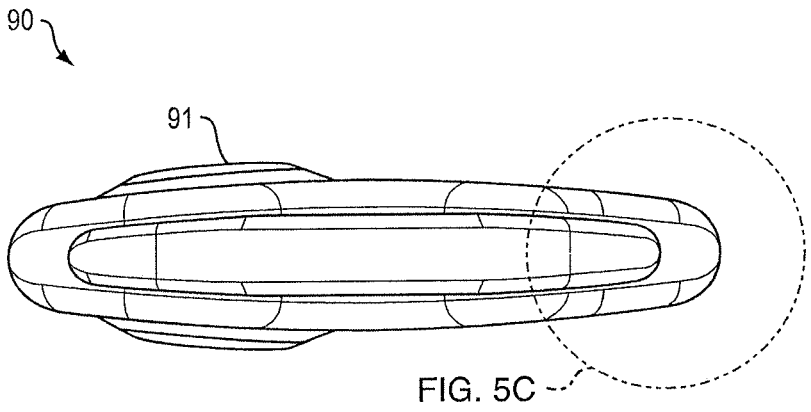
Figure 5C:
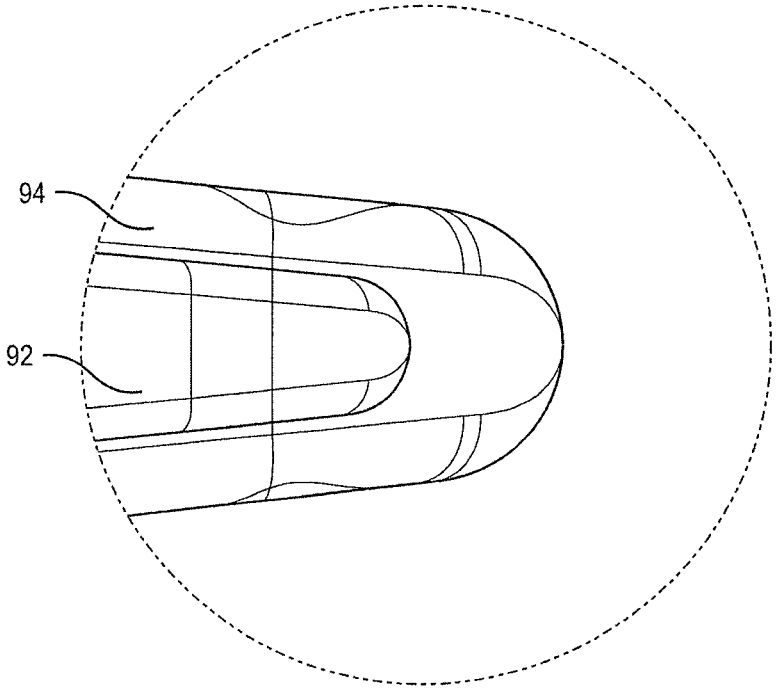
Figure 5D:
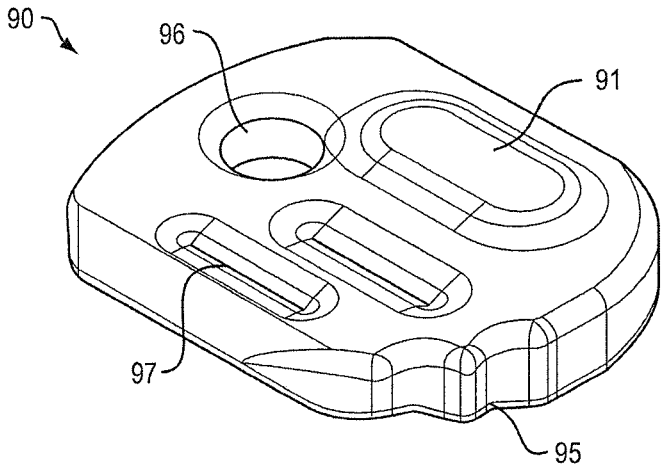

Embodiment 80, FIG. 4, has a slightly different cross-sectional shape and can have a generally elongated tubular shape to mimic the shape of a finger. Body 82 is made of one material and can have one, two or more interior volumes (two such volumes 88 and 89 shown) of a different material and/or voids to accomplish a varied compressibility along its length. End regions 84 and 86 can be a different material as well.

FIG. 5 shows one of many possible physical designs of the teether. Teether 90 is, broadly, flat and thin. Teether 90 is constructed from elastomeric core 92 overmolded with softer silicone or similar elastomeric material 94. Outer layer 94 defines peaks and valleys (e.g., peak 91 and valleys 93 and 97), hole 96 and scalloped edges 95 that accomplish angles that provide for different responses in different areas of the teether. Teether 90 will display a viscoelastic response that mimics the response of solid foods. This particular teether is designed to be for 3+ months as it is very soft and elastically responsive. This produces a response similar to pureed/rice pudding like foods. The soft compressive nature of the elastomeric set-up allows the child to freely bite on the teether surface, while loading the TMJ/jaw to strengthen for the next level of feeding progression. The angles help to alter the direction of the load on the TMJ, i.e., as in Nickel J C, et al (1988), the load and angle of load are involved in TMJ development. This will not only help strengthen the muscles and joints, but will also encourage development of the bite to be more incisor (anterior) based during initial bite.

Figure 6A:
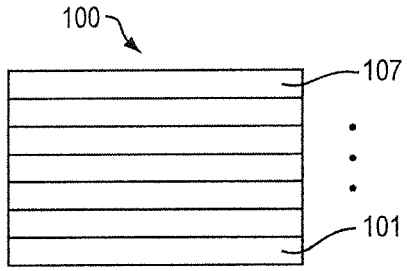
FIGS. 6A and 6B schematically and conceptually illustrate a variable-response construction that can be used in the teether.
Figure 6B:
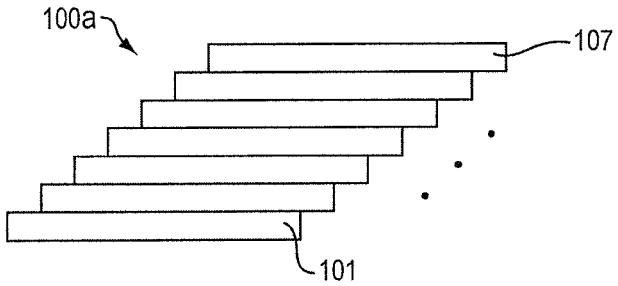

FIGS. 6A and 6B schematically and conceptually illustrate a variable-response construction that can be used in the invention. Construction 100 is a stack of seven thin layers or plates 101-107 that can be arranged to be vertically aligned as shown in FIG. 6A or partially misaligned as shown in FIG. 6B. When the layers are aligned the stack provides the greatest resistance to vertical forces, and so when used in the interior of a teether (for example a teether of the type shown in FIG. 1-5) construction 100 accomplishes a stiff teether, appropriate for older children. As the plates are moved to become more misaligned as illustrated for example in construction 100*a* FIG. 6B, the stack exhibits greater vertical compliance and so can accomplish a more easily compressed teether. Also, the material, construction and thickness of the individual plates can be tailored to achieve a desired elastic or viscoelastic response to compressive forces. The result is that a stack such as this can be used to accomplish different response to compressive forces as a means to at least partially accomplish an aim of the teether.

Note that this stack concept can be applied to the teether literally, or more conceptually. For example, the stack can be arranged and then tested (for example using an Instron tester), as a means to determine proper design of a unitary or integral interior elastic member of the type shown in FIG. 1-5.

Figure 7:
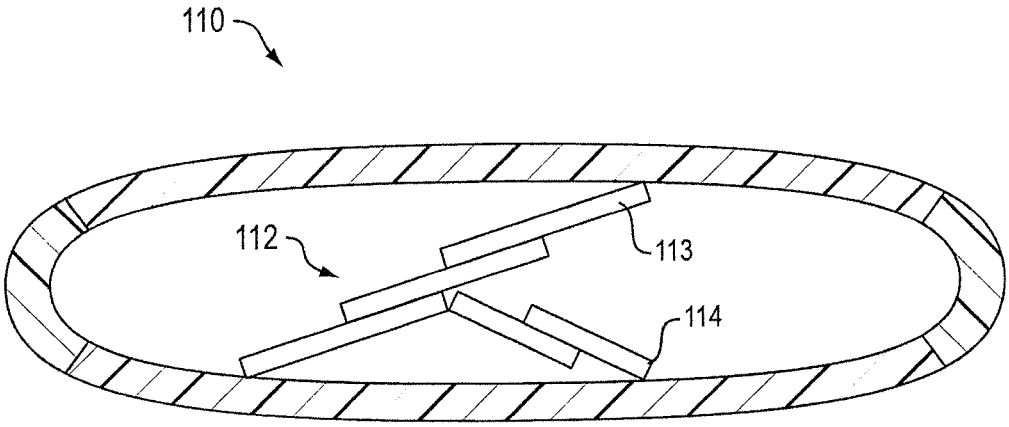
FIG. 7 is a simplified side cross-sectional view of an embodiment of the teether that employs the construction of FIGS. 6A and 6B.
Figure 8:
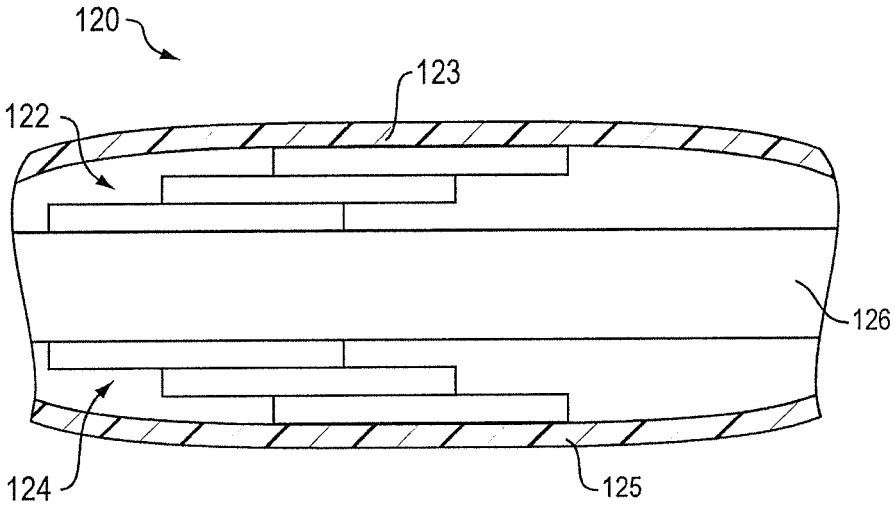
FIG. 8 is a simplified partial side cross-sectional view of another embodiment of the teether that employs the construction of FIGS. 6A and 6B.

The concepts of FIGS. 6A and 6B are shown in context (again, schematically and somewhat conceptually) in the examples of FIGS. 7 and 8. Teether 110, FIG. 7, uses "spring" 112 to provide some or all of its compliance. Spring 112 comprise interconnected intersecting strings 113 and 114 of plates (or a construction modeled by plates) to accomplish a certain compliance. Obviously the material, length, thickness and/or angles (and relative angles) of strings 113 and 114 can be varied to accomplish a desired elastic or viscoelastic response.

Yet another broadly similar embodiment 120 is shown in FIG. 8. In this example, internal hollow channel 126 is employed to contribute to the compliance. Plate string (or equivalent) 122 is located between hollow or filled channel 126 and upper surface 123, and string (or equivalent) 124 is located between lower surface 125 and channel 126.

Figure 9:
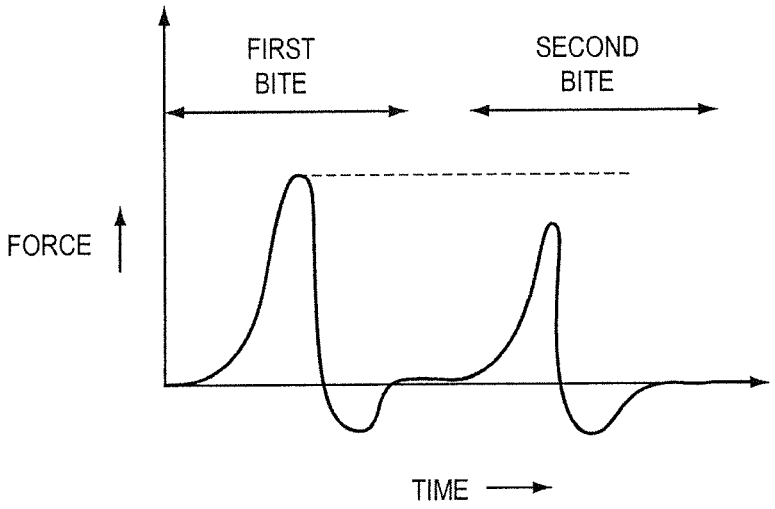
FIG. 9 is a graph illustrating time versus force for two bites into food, which helps to understand the varied response of certain embodiments of the teether.
Figure 10:
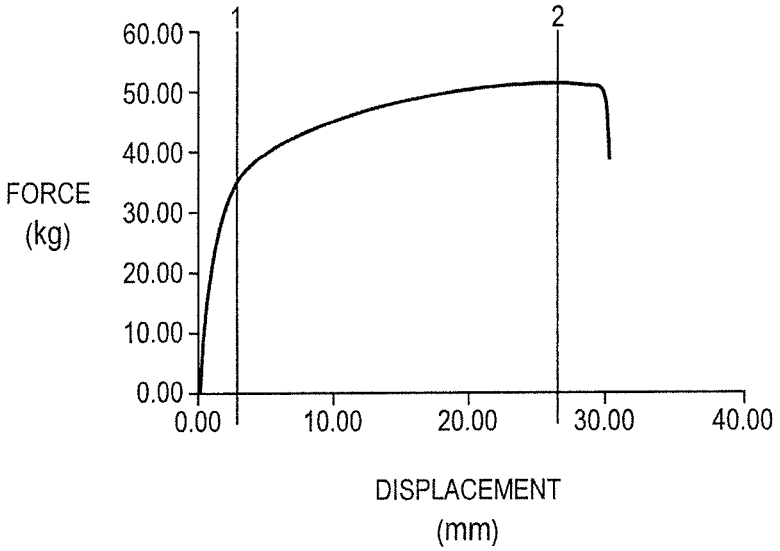
FIG. 10 is a displacement/force curve for testing of a strawberry.
Figure 11:
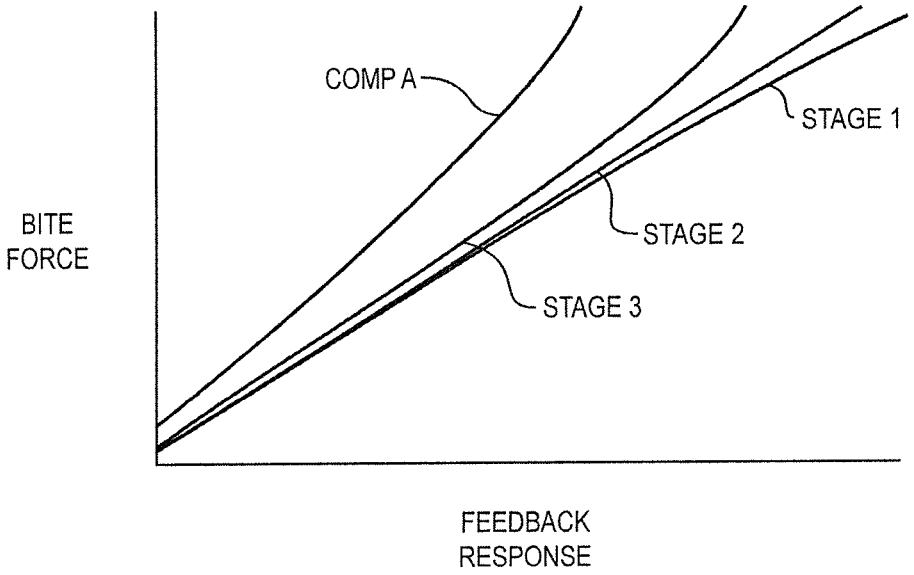
FIG. 11 is a comparison of three teethers to a prior art teether.
Figure 12A:
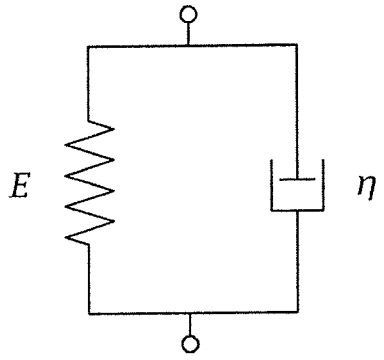
FIGS. 12A and 12B are a schematic model of a viscoelastic material and corresponding creep recovery curve that are useful in understanding the teether designs.
Figure 12B:
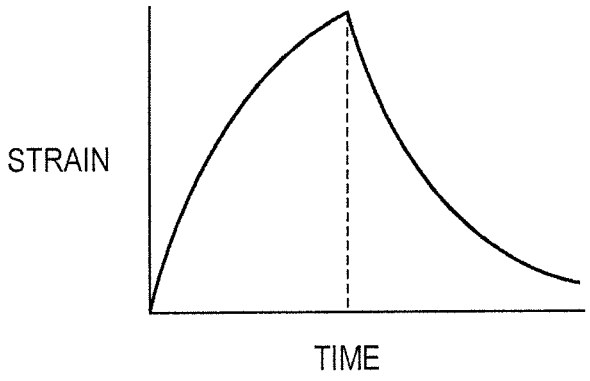

FIG. 9 is a force diagram of the biting force realized as food is chewed. This graph reflects the fact that force per bite decreases as the food is masticated. The variable response teether of this invention can mimic this type of force profile through selection of design, materials and placement of the teether by the infant/toddler.

Figure 13A:
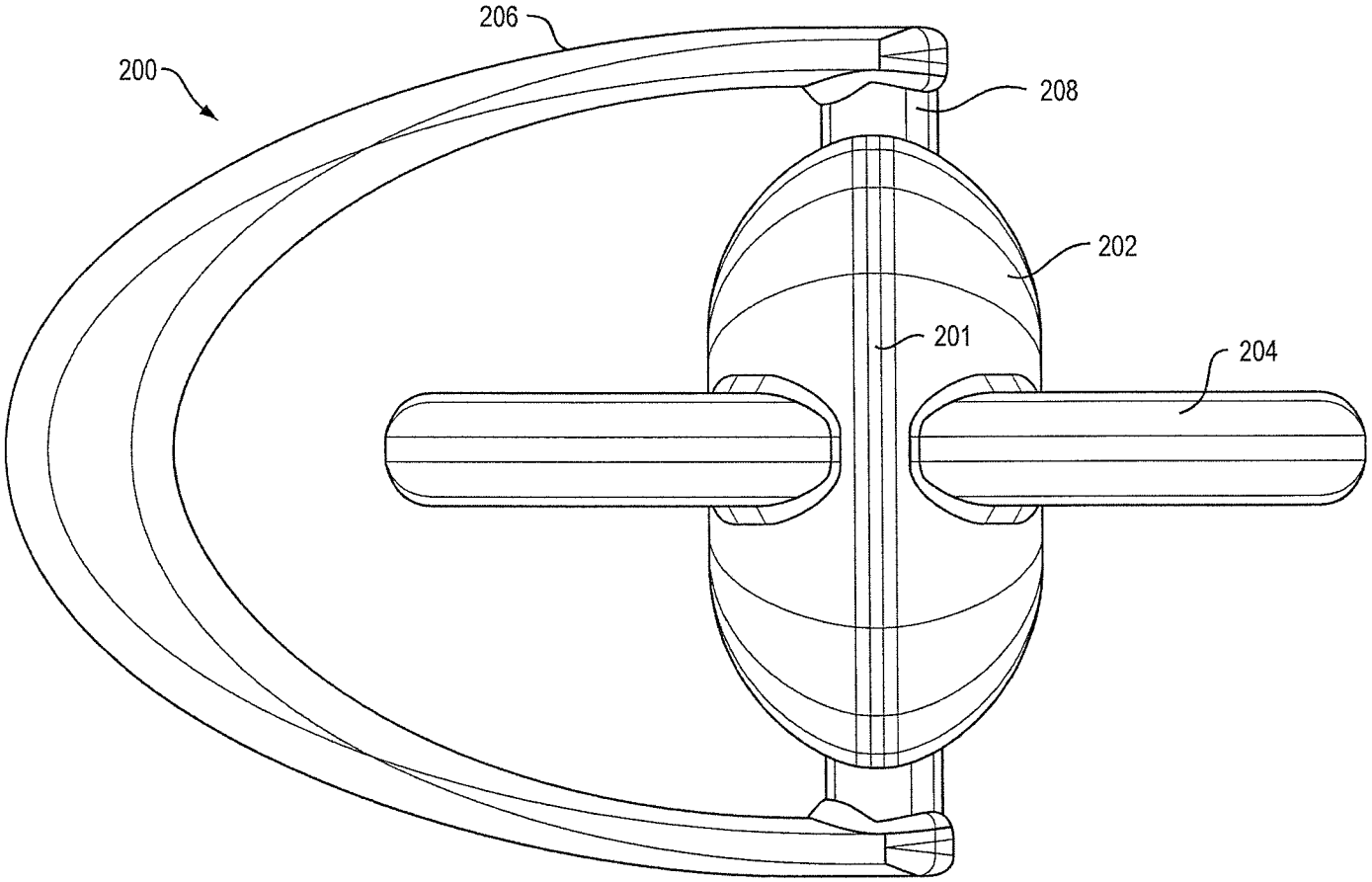
FIGS. 13A and 13B show another varied response teether design.
Figure 13B:
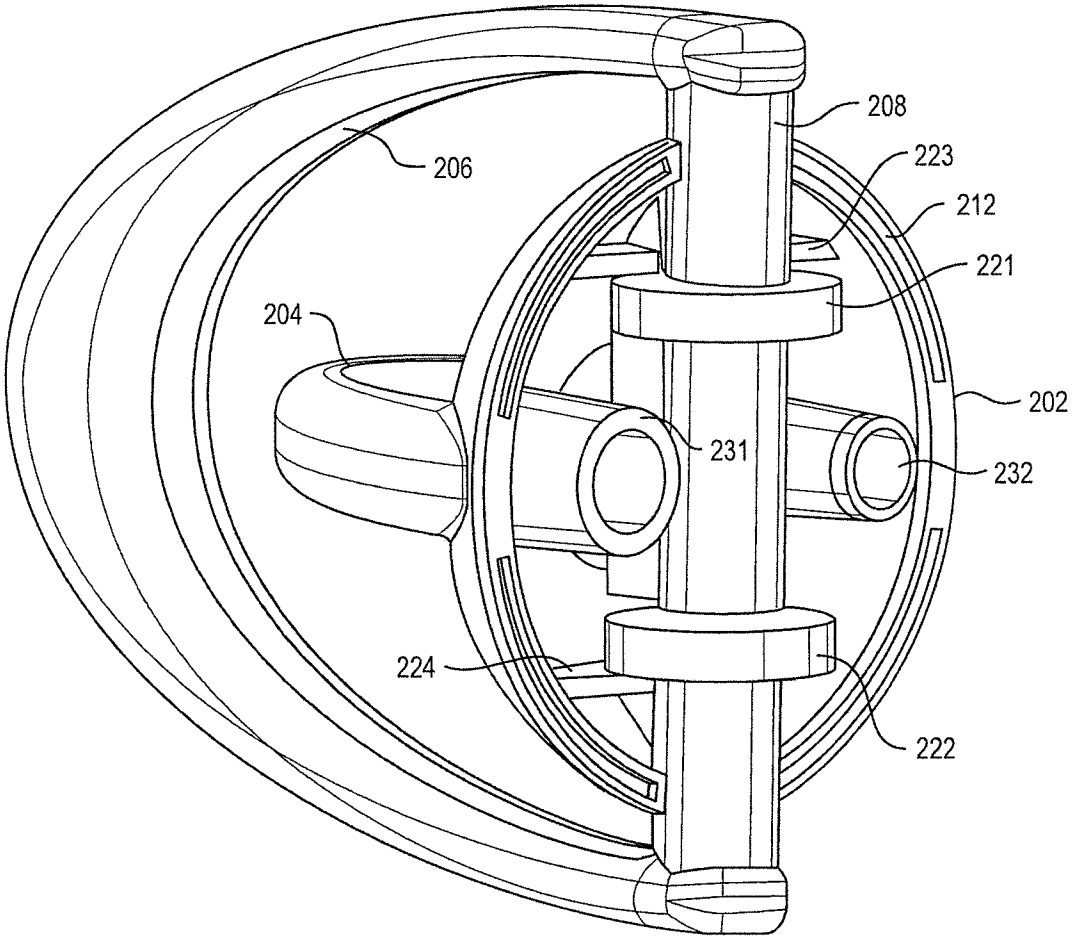

FIGS. 13A and 13B illustrate a teether 200 that has multiple bite surfaces and is comprised of a main planet like structure 202 that has two elastomeric overmolded sections 204 and 212 for bite response and an outer orbit ring 206 that is allowed to rotate freely around the planet due to an axle like structure 208 that connects the two parts. Structure 202 carries peg 232 and peg-receiving cylinder 231. The other half of teether 200 (not shown in FIG. 13B) has a mirror image construction to create two peg in cylinder press fit structures that hold the two halves of planet 202 together while they are ultrasonically welded together along seam area 201. Both planet structure 202 and section 204 have an internal structure that is similarly shaped and typically (but not necessarily) of different hardness (typically harder) than the overmolded sections to accomplish structure for the overmolding as well as contribute to the bite response. The dimensions of the outer orbit ring 206 are such to allow the infant to bite around the ring, i.e., can close their lips around the ring to accomplish a lip seal gesture; the act of sealing the lips around an item or object allows one to hold food or liquids in the mouth without spilling. Also, ring 206 being spaced from planet 202 provides an open area for hand-eye coordination and acts as a handle. The planet 202 can spin about axle 208 via discs 221 and 222 on axle 208 and matching plates with central openings 223 and 224 on the inside of planet 202 that allow discs 221 and 222 to float while limiting vertical movement and allowing planet 202 to spin freely about axle 208.

While the invention has been described in some detail for purposes of clarity and understanding, particular embodiments are to be considered as illustrative and not restrictive. It will be appreciated by one skilled in the art from a reading of this disclosure that certain changes in form or detail may be made without departing from the scope of the invention and are within the scope of the following claims. For example, features shown in some drawings and not others may be combined in different manners in accordance with the invention.

What is claimed is:

1. A varied response teether configured to be used in the mouth human child to load and strengthen the child's temporomandibular joint (TMJ) and jaw, comprising:

a compressible, elastically-responsive elastomeric core made from a first elastomeric material having a first hardness;

an outer compressible, elastically-responsive layer overmolded on the core so as to cover some but not all of the core, where the outer layer is made from a second elastomeric material having a second hardness that is different than the first hardness;

wherein the core and outer layer together define first and second spaced opposed faces, an edge along a circumference of the teether, where the edge connects the faces, and a through-hole passing through the core and outer layer from the first face to the second face;

wherein the core and outer layer together have an outer circumference that defines a first end with a first radius of curvature, an opposed second end with a second radius of curvature that is less than the first radius of curvature, and two sides that connect the first and second ends, where the sides are generally straight;

wherein the outer layer further defines first and second projections, one projection on each face, each projection comprising a top located above the face, and outwardly tapered angled sides that meet the respective face, such that the projections narrow from a base where they meet the face, to the top;

wherein the outer layer further defines at least a first depression in one face that comprises a bottom located below the face, and outwardly-tapered angled sides that meet the face, such that the first depression has a larger circumference at the top where it meets the face than the circumference at its bottom; and wherein the core and outer layer together further define two adjacent arc-shaped depressions in the second end that each extend along a part of the circumference of the teether and across the entire edge between the first and second faces.

2. The varied response teether of claim 1, wherein along a first part of the edge, the core is exposed and covered on both sides by the outer layer, such that along this first part of the edge there are exposed upper and lower layers of the second elastomeric material and an exposed middle layer of the first elastomeric material.

3. The varied response teether of claim 1, wherein the first elastomeric material is harder than the second elastomeric material.

4. The varied response teether of claim 1, wherein the outer layer further defines a second depression in one face that comprises a bottom located below the face, and outwardly-tapered angled sides that meet the face, such that the second depression has a larger circumference at the top where it meets the face than the circumference at its bottom.

5. The varied response teether of claim 4, wherein the second depression is in the same face as the first depression.

6. The varied response teether of claim 5, wherein the bottoms of the first and second depressions are each generally oval shaped.

7. The varied response teether of claim 1, wherein the two adjacent arc-shaped depressions are each continuously curved.

8. The varied response teether of claim 1, wherein the two adjacent arc-shaped depressions are each blended into one of the faces, such that for each arc-shaped depression there is a slanted arc-shaped border between the face and the depression.

9. The varied response teether of claim 1, comprising at least three stacked layers.

10. The varied response teether of claim 9, wherein each stacked layer is made from an elastomeric material.

11. A varied response teether configured to be used in the mouth of a human child to load and strengthen the child's temporomandibular joint (TMJ) and jaw, comprising:

a compressible, elastically-responsive elastomeric core made from a first elastomeric material having a first hardness;

an outer compressible, elastically-responsive layer overmolded on the core so as to cover some but not all of the core, where the outer layer is made from a second elastomeric material that is softer than the first material;

wherein the core and outer layer together define first and second spaced opposed faces, an edge along a circumference of the teether, where the edge connects the faces, and a through-hole passing through the core and outer layer from the first face to the second face;

wherein the core and outer layer together have an outer circumference that defines a first end with a first radius of curvature, an opposed second end with a second radius of curvature that is less than the first radius of curvature, and two sides that connect the first and second ends, where the sides are generally straight;

wherein the outer layer further defines first and second projections, one projection on each face, each projection comprising a top located above the face, and outwardly tapered angled sides that meet the respective face, such that the projections narrow from a base where they meet the face, to the top;

wherein the outer layer further defines first and second shaped depressions in one face, each depression comprising a bottom located below the face, and outwardly-tapered angled sides that meet the face, such that the depression has a larger circumference at the top where it meets the face than the circumference at its bottom; and wherein along a first part of the edge, the core is exposed and covered on both sides by the outer layer, such that along this first part of the edge there are exposed upper and lower layers of the second elastomeric material and an exposed middle layer of the first elastomeric material, and wherein along the second end there are two adjacent arc-shaped depressions each extending along a part of the circumference of the teether and across the entire edge between the first and second faces.

12. A varied response teether configured to be used in the mouth of a human child to load and strengthen the child's temporomandibular joint (TMJ) and jaw, comprising:

a compressible, elastically-responsive elastomeric core made from a first elastomeric material having a first hardness;

an outer compressible, elastically-responsive layer overmolded on the core so as to cover some but not all of the core, where the outer layer is made from a second elastomeric material having a second hardness that is different than the first hardness;

wherein the core and outer layer together define first and second spaced opposed faces, an edge along a circumference of the teether, where the edge connects the faces, and a through-hole passing through the core and outer layer from the first face to the second face;

wherein the core and outer layer together have an outer circumference that defines a first end with a first radius of curvature, an opposed second end with a second radius of curvature that is less than the first radius of curvature, and two sides that connect the first and second ends, where the sides are generally straight;

wherein the outer layer further defines first and second projections, one projection on each face, each projection comprising a top located above the face, and outwardly tapered angled sides that meet the respective face, such that the projections narrow from a base where they meet the face, to the top;

wherein the outer layer further defines at least a first depression in one face and that comprises a bottom located below the face, and outwardly-tapered angled sides that meet the face, such that the first depression has a larger circumference at the top where it meets the face than the circumference at its bottom; and wherein the core and outer layer together further define two adjacent arc-shaped depressions in the second end that each extend along a part of the circumference of the teether and across the entire edge between the first and second faces, wherein the two adjacent arc-shaped depressions are each continuously curved and are each blended into one of the faces, such that for each arc-shaped depression there is a slanted arc-shaped border between the face and the depression.

* * * * *